US007163657B2

(12) United States Patent
Heinrich et al.

(10) Patent No.: US 7,163,657 B2
(45) Date of Patent: Jan. 16, 2007

(54) CEMENTED CARBIDE BODY CONTAINING ZIRCONIUM AND NIOBIUM AND METHOD OF MAKING THE SAME

(75) Inventors: Hans-Wilm Heinrich, Bayreuth (DE); Manfred Wolf, Eckersdorf (DE); Dieter Schmidt, Bayreuth (DE)

(73) Assignee: Kennametal Inc., Latrobe, PA (US)

( * ) Notice: Subject to any disclaimer, the term of this patent is extended or adjusted under 35 U.S.C. 154(b) by 97 days.

(21) Appl. No.: 10/727,247

(22) Filed: Dec. 3, 2003

(65) Prior Publication Data

US 2005/0120825 A1 Jun. 9, 2005

(51) Int. Cl.
*B22F 3/15* (2006.01)

(52) U.S. Cl. ..... 419/13; 419/14; 419/15; 419/18; 419/38; 419/40; 419/60

(58) Field of Classification Search ..... 419/13–15, 419/38, 49, 60, 18
See application file for complete search history.

(56) References Cited

U.S. PATENT DOCUMENTS

| | | | | |
|---|---|---|---|---|
| 2,113,355 | A * | 4/1938 | McKenna | 75/241 |
| 2,731,710 | A * | 1/1956 | Lucas et al. | 75/242 |
| 3,999,954 | A | 12/1976 | Kolaska et al. | |
| 4,145,213 | A | 3/1979 | Oskarsson et al. | |
| 4,451,292 | A * | 5/1984 | Hall et al. | 75/238 |
| 4,843,039 | A | 6/1989 | Akesson et al. | |
| RE34,180 | E | 2/1993 | Nemeth et al. | |
| 5,447,549 | A | 9/1995 | Yoshimura | |
| 5,503,925 | A | 4/1996 | Nakano et al. | |
| RE35,538 | E | 6/1997 | Akesson et al. | |
| 5,643,658 | A | 7/1997 | Uchino et al. | |
| 5,746,803 | A | 5/1998 | Dunmead et al. | |
| 6,024,776 | A | 2/2000 | Heinrichg et al. | |
| 6,207,262 | B1 * | 3/2001 | Ichikawa et al. | 428/216 |
| 2001/0006594 | A1 | 7/2001 | Shibata | |
| 2003/0010166 | A1 | 1/2003 | Shibata | |
| 2003/0129456 | A1 | 7/2003 | Usami et al. | |

FOREIGN PATENT DOCUMENTS

| | | | |
|---|---|---|---|
| CN | 1425787 | * | 6/2003 |
| EP | 0 360 567 | B1 | 7/1997 |
| EP | 0 900 860 | A2 | 3/1999 |
| EP | 0 900 860 | A3 | 11/2002 |
| EP | 0 900 860 | B1 | 4/2004 |
| JP | 02185941 | A | 7/1990 |
| JP | 10237650 | A | 9/1998 |
| JP | 2002356734 | A | 12/2002 |
| RU | 2007491 | * | 2/1994 |

OTHER PUBLICATIONS

PCT Search Report for International Application No. PCT/EP2004/011170 dated Apr. 11, 2005, 12 pages.

* cited by examiner

*Primary Examiner*—Ngoclan T. Mai
(74) *Attorney, Agent, or Firm*—John J. Prizzi

(57) ABSTRACT

A sintered cemented carbide body (e.g., a cutting tool) and a method of making the same. The sintered cemented carbide body includes tungsten carbide, a binder phase of at least one metal of the iron group or an alloy thereof, and one or more solid solution phases. Each one of the solid solution phases has at least one of the carbides and carbonitrides of a combination of zirconium, niobium, and tungsten. The method includes the steps of providing a powder mixture that contains tungsten carbide, a binder metal powder comprising at least one metal of the iron group or an alloy thereof, and at least one of the carbides and carbonitrides of both zirconium and niobium including a powder of the carbides or carbonitrides of zirconium and niobium, forming a green compact of said powder mixture, and vacuum sintering or sinter-HIP said green compact at a temperature of from 1400 to 1560° C.

12 Claims, 4 Drawing Sheets

CEMENTED CARBIDE BODY CONTAINING ZIRCONIUM AND NIOBIUM AND METHOD OF MAKING THE SAME

BACKGROUND OF THE INVENTION

The present invention provides sintered cemented carbide bodies having increased resistance to plastic deformation comprising tungsten carbide (WC), a binder metal phase and one or more solid solution phases comprising at least one of the carbides, nitrides and carbonitrides of at least one of the elements of groups IVb, Vb and VIb of the Periodic Table of Elements. The present invention also provides a method for producing these sintered cemented carbide bodies. These sintered cemented carbide bodies are useful in the manufacture of cutting tools, and especially indexable cutting inserts for the machining of steel and other metals or metal alloys.

Sintered cemented carbide bodies and powder metallurgical methods for the manufacture thereof are known, for example, from U.S. Pat. Re. 34,180 to Nemeth et al. While cobalt has originally been used as a binder metal for the main constituent, tungsten carbide, a cobalt-nickel-iron alloy as taught by U.S. Pat. No. 6,024,776 turned out to be especially useful as a binder phase for tungsten carbide and other carbides, nitrides and carbonitrides of at least one of the elements titanium, zirconium, hafnium, vanadium, niobium, tantalum, chromium, molybdenum and tungsten, respectively.

Numerous attempts have been made in order to modify the properties or characteristics of the sintered cemented carbide bodies prepared by powder metallurgical methods. These properties include, but are not limited to, hardness, wear resistance, plastic deformation at increased temperatures, density, magnetic properties, resistance to flank wear and resistance to cratering. In order to provide cutting tools having improved wear properties at high cutting speeds, it is known, for example, that the sintered cemented carbide bodies should have increased contents of titanium or tantalum and niobium. On the other hand, however, it is known that increasing contents of titanium or tantalum or niobium result in a noticeable reduction of strength as they form solid solution carbides with tungsten carbide, since the amount of tungsten carbide-phase which provides for the maximum strength in a sintered cemented carbide body decreases with the formation of solid solution carbides.

Also well known to those skilled in the art is the fact that the addition of zirconium and hafnium increases the strength of sintered cemented carbide bodies both at room temperature and at higher temperatures. However, the increase in strength is combined with lower hardness and decreased wear resistance. In addition, a disadvantage of the addition of zirconium is its high affinity to oxygen and its poor wettability which impedes the sintering process used in the preparation of the sintered cemented carbide body.

U.S. Pat. Nos. 5,643,658 and 5,503,925, both hereby incorporated by reference herein, aim at improving hot hardness and wear resistance at higher temperatures of sintered cemented carbide bodies by means of adding zirconium and/or hafnium carbides, nitrides and carbonitrides to the powder mixture of tungsten carbide and a binder metal of the iron family. As a result thereof, the hard phases of at least one of zirconium and hafnium coexist with other hard phases of metals of groups IVb, Vb and VIb, but excluding zirconium and hafnium, with said hard phases forming, in each case, solid solutions with tungsten carbide. Due to the high affinity of zirconium for oxygen, either the starting powder materials have to be extremely low in oxygen, or the oxygen content has to be controlled by using a reducing sintering atmosphere.

JP-A2-2002-356734, published on Dec. 13, 2002, discloses a sintered cemented carbide body comprising WC, a binder phase consisting of at least one metal of the iron group, and one or more solid solution phases, wherein one of said solid solution phases comprises Zr and Nb while all solid solution phases other than the first one comprise at least one of the elements Ti, V, Cr, Mo, Ta and W, but must not comprise Zr and Nb. According to this Japanese patent document, the best cutting results are achieved at a tantalum content of less than 1% by weight of the total composition, calculated as TaC.

The present invention aims at achieving new sintered cemented carbide bodies having increased resistance to plastic deformation at increased temperatures and, as a result thereof, having increased wear resistance. Besides, the present invention aims at providing a powder metallurgical method of producing said sintered cemented carbide bodies. More specifically, it is an object of the present invention to provide a sintered cemented carbide body having at least two co-existing solid solution phases containing zirconium and niobium or one single homogenous solid solution phase containing zirconium and niobium.

Another object of the present invention consists in providing a method of producing said sintered cemented carbide body comprising the step of providing a powder mixture which upon sintering provides at least two co-existing solid solution phases or one single homogenous solid solution phase containing, in each case, zirconium and niobium, and providing improved sintering activity and wettability with hard constituents of elements of groups IVb, Vb, and VIb of the periodic table of elements.

SUMMARY OF THE INVENTION

In one form thereof, the invention is a sintered cemented carbide body that has increased resistance to plastic deformation. The sintered cemented carbide body includes tungsten carbide, and a binder phase that includes at least one metal of the iron group or an alloy thereof, and one or more solid solution phases wherein each one of the solid solution phases comprises at least one of the carbides and carbonitrides of a combination comprising zirconium, niobium, and tungsten.

In another form thereof, the invention is a method of producing a sintered cemented carbide body comprising the steps of: providing a powder mixture comprising tungsten carbide, a binder metal powder comprising at least one metal of the iron group or an alloy thereof, and at least one of the carbides and carbonitrides of both zirconium and niobium; forming a green compact of said powder mixture; and vacuum sintering or sinter-HIP said green compact at a temperature of from 1400 to 1560° C.

In yet another form thereof, the invention is a cutting tool that comprises a body that includes a rake face and a flank face wherein the rake face and the flank face intersect to form a cutting edge at the intersection thereof. The body comprises tungsten carbide, a binder phase comprising at least one metal of the iron group or an alloy thereof, and one or more solid solution phases each one of which comprising at least one of the carbides and carbonitrides of a combination comprising zirconium, niobium, and tungsten.

In still another form thereof, the invention is a sintered cemented carbide body that has increased resistance to plastic deformation. The sintered cemented carbide body includes tungsten carbide, and a binder phase that includes at least one metal of the iron group or an alloy thereof, and one or more solid solution phases wherein each one of the solid solution phases comprises at least one of the carbides and carbonitrides of a combination consisting of zirconium, niobium, and tungsten

BRIEF DESCRIPTION OF THE DRAWINGS

The following is a brief description of the drawings that form a part of this patent application.

DETAILED DESCRIPTION OF SPECIFIC EMBODIMENTS

Figure 1:
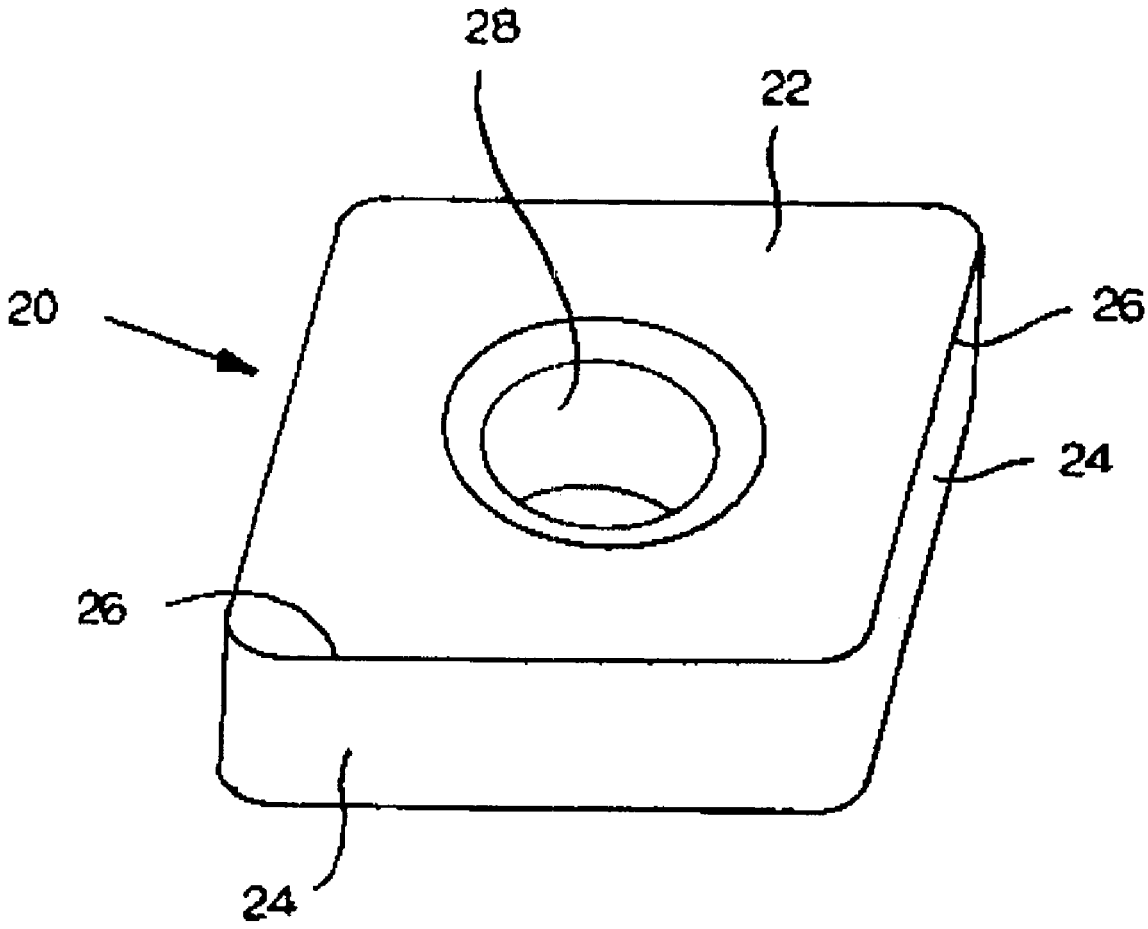
FIG. 1 is an isometric view of a cutting tool of the present invention wherein the cutting tool is a CNMG style of cutting tool.
Figure 5:
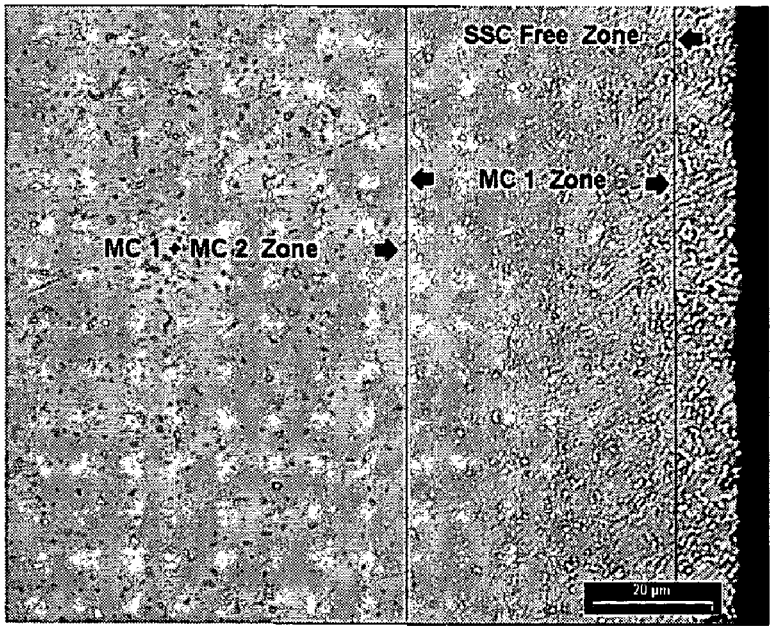
FIG. 5 is a photomicrograph (20 micrometer scale) showing the unetched microstructure of an other embodiment of the sintered cemented carbide body of the present invention wherein there is shown a binder enriched surface zone free of solid solution carbide wherein the binder enriched surface zone begins at and extends inwardly from the surface of the substrate and underneath the binder enriched surface zone free of solid solution phase there is shown a zone in which a single phase MC1 exists (MC1 is light brown), and underneath the MC1 zone there is a zone that has two coexisting solid solution carbide phases wherein one solid solution phase is MC land it is light brown and the other solid solution phase is MC 2 and it is dark brown.

Referring to FIG. 1, there is shown a cutting tool, i.e., a sintered cemented carbide body, generally designated as 20. Cutting tool 20 has a rake face 22 and flank faces 24. There is a cutting edge 26 at the intersection of the rake face 22 and the flank faces 24. The cutting tool 20 further contains an aperture 28 by which the cutting tool 20 is secured to a tool holder. The style of cutting tool shown in FIG. 5 is a CNMG style of cutting tool. The illustration in FIG. 1 of a CNMG style of cutting tool should not be considered to limit the scope of the invention. It should be appreciated that the present invention is a new cemented carbide material that can be used as a cutting tool wherein the geometry of the cutting tool can be any known cutting tool geometry.

In regard to the composition of the cutting tool, i.e., a sintered cemented carbide body, the composition contains tungsten carbide and a binder, as well as one or more solid solution phases that comprise the carbides and/or the carbonitrides of a combination of zirconium, niobium and tungsten as exemplified by the formulae (Zr,Nb,W)C and/or (Zr,Nb,W)CN. In one preferred embodiment of the composition, just one of the solid solution phases consists of a carbide or carbonitride of a combination of zirconium, niobium and tungsten. In another preferred embodiment of the composition, the solid solution phase consisting of a carbide or carbonitride of a combination of zirconium, niobium and tungsten is the sole solid solution phase of the body wherein no other element such as titanium, hafnium, vanadium, tantalum, chromium, and molybdenum is present in said solid solution phase.

In yet another preferred embodiment of the composition, one of the solid solution phases comprises a carbide or carbonitride of a combination of zirconium, niobium and tungsten and at least one carbide, nitride or carbonitride of one or more of titanium, hafnium, vanadium, tantalum, chromium, and molybdenum wherein the solid solution phase may be either the sole solid solution phase of the body or one of two or more different solid solution phases. More specifically, there can be two or more different solid solution phases that are present with each solid solution phase comprising a carbide or carbonitride of a combination of zirconium, niobium and tungsten, and at least one carbide, nitride or carbonitride of one or more of titanium, hafnium, vanadium, tantalum, chromium and molybdenum, respectively. In those cases where the solid solution phase comprises a carbide or carbonitride of a combination of zirconium, niobium and tungsten, and at least one carbide, nitride or carbonitride comprising one or more other metals, it is even more preferred that said at least one other metal is one or more of titanium, tantalum and hafnium.

According to the present invention, the binder alloy preferably comprises cobalt, a CoNi-alloy or a CoNiFe-alloy, each of which may or may not contain additional alloying elements such as chromium and tungsten. The binder alloy preferably comprises between about 3 weight percent to about to 15 weight percent of the total body.

Preferably, the total contents of a carbide or carbonitride of a combination of zirconium, niobium and tungsten of the one or more solid solution phase(s) comprise between about 1 weight percent and about 15 weight percent of the total body. Also preferred are those embodiments of the present invention wherein the total content of the elements titanium, hafnium, vanadium, tantalum, chromium and molybdenum does not exceed about 8 weight percent of the total body.

According to especially preferred embodiments of the present invention, titanium comprises between about 1 weight percent and about 8 weight percent of the total body, tantalum comprises between about 1 weight percent and about 7 weight percent of the total body, and hafnium comprises between about 1 weight percent and about 4 weight percent of the total body.

If the cemented carbide body has a mass ratio Nb/(Zr+Nb) of greater than about 0.5, and more preferably greater than or equal to about 0.6, the formation of a single homogeneous solid solution phase or the formation of two or more coexisting solid solution phases within the sintered cemented carbide body is remarkably increased.

Figure 4:
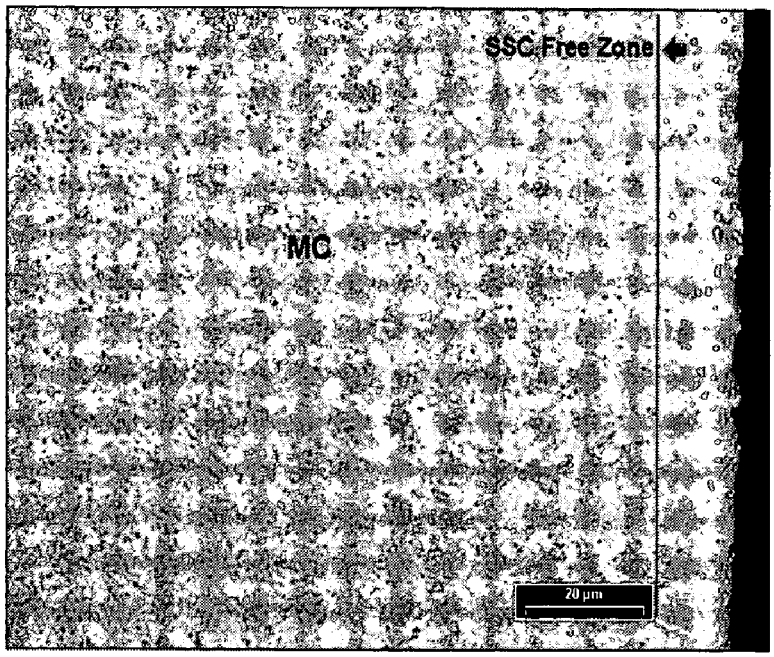
FIG. 4 is a photomicrograph (20 micrometer scale) showing the unetched microstructure of an embodiment of the sintered cemented carbide body of the present invention wherein there is shown a binder enriched surface zone free of solid solution carbide wherein the binder enriched surface zone begins at and extends inwardly from the surface of the substrate and one single homogeneous solid solution phase (MC)

According to still another aspect of the present invention, the sintered cemented carbide body comprises at least one of said nitrides or carbonitrides and comprises an outermost zone being free of any solid solution phase but binder enriched up to a depth of about 50 micrometers (μm) from an uncoated surface of said body. Embodiments of this type are shown in FIGS. 4 and 5 hereof.

As is acknowledged by those having ordinary skill in the art, binder enrichment and formation of a surface zone free of solid solution carbide (SSC) is induced during sintering once at least one nitride or carbonitride is present in the starting powder mixture. Due to the formation of free nitrogen during sintering, diffusion of binder metal from the bulk towards the surface, and diffusion of solid solution phase from the surface zone towards the bulk will take place, resulting in a binder enriched surface zone being free of any solid solution phase. Due to these diffusion processes, two or more coexisting different solid solution phases showing a concentration gradient between the surface and the center of the body are formed underneath of the binder enriched zone, according to a still more preferred embodiment of the present invention. In those cases, however, where just one single solution phase being homogeneous throughout the body is present, said one single and homogeneous solid solution phase will be located underneath of the binder enriched zone such that the single solid solution phase is homogeneous throughout said body, except in the binder enriched zone.

According to still other preferred embodiments of the present invention, one or more wear resistant layers deposited according to well-known physical vapor deposition (PVD) or chemical vapor deposition (CVD) methods are coated over a surface of the sintered cemented carbide body. Preferably, these wear resistant coatings comprise one or more of the carbides, nitrides, carbonitrides, oxides or borides of a metal of the groups IVb, Vb and VIb of the periodic table of elements, and alumina.

Referring to the method aspects of the present invention, according to a preferred embodiment of the method of the present invention, a solid solution of a carbide or carbonitride of a combination of zirconium and niobium having a mass ratio Nb/(Zr+Nb) of greater than about 0.5, and preferably greater than or equal to about 0.6 or more, is used as the powdered solid solution of a carbide or carbonitride of a combination of zirconium and niobium. The powdered solid solution of a carbide or carbonitride of a combination of zirconium, niobium and tungsten preferably comprises between about 1 weight percent and about 15 weight percent of the total powder mixture.

Preferably, cobalt powder, powders of cobalt and nickel or powders of cobalt and nickel and iron or powders of a cobalt-nickel alloy or powders of a cobalt-nickel-iron alloy are used as the binder metal powders, within the method of the present invention. Optionally, the binder metal powders may include additional elements, preferably one or more of chromium and tungsten. Preferably, the binder metal powder comprises between about 3 weight percent and about 15 weight percent of the total powder mixture.

According to still another embodiment of the present invention, the powder mixture additionally comprises at least one carbide, nitride or carbonitride of one or more of titanium, hafnium, vanadium, tantalum, chromium, and molybdenum. Preferably, the powder mixture comprises at least one of the elements titanium, hafnium, vanadium, tantalum, chromium and molybdenum in an amount of between about 1 weight percent and about 8 weight percent of the total powder mixture.

The present inventors have surprisingly found that due to the addition of zirconium and niobium in the form of a powdered solid solution of a carbide or carbonitride of a combination of zirconium and niobium to the starting powder mixture, instead of using zirconium carbide plus niobium carbide or zirconium carbonitride plus niobium carbonitride, each individually, either one single homogeneous solid solution phase comprising the carbides and/or the carbonitrides of a combination of zirconium, niobium and tungsten, or two or more coexisting solid solution phases comprising the carbides and/or the carbonitrides of a combination of zirconium, niobium and tungsten, and at least one carbide, nitride or carbonitride of one or more of titanium, hafnium, vanadium, tantalum, chromium and molybdenum, depending on the compounds added to the starting powder mixture, are formed during sintering according to the method of the present invention.

Contrary to the documents mentioned herein above, upon sintering all elements added to the starting powder mixture are dissolved in each one of the coexisting solid solution phases, according to the present invention. For example, up to about 65 weight percent tungsten, up to about 75 weight percent niobium, up to about 60 weight percent zirconium, up to about 20 weight percent titanium, up to about 15 weight percent tantalum, and up to about 20 weight percent hafnium can be dissolved in the coexisting solid solution phases.

Another advantage of the use of a powdered solid solution of a carbide or carbonitride of a combination of zirconium and niobium as part of the starting powder mixture according to the present invention is the fact that tantalum can be added to the composition for improving binder phase distribution and toughness in an amount of about 1 weight percent or more of the total starting powder mixture.

The best results in terms of homogeneity of the solid solution phase(s) formed according to the present invention have been obtained if a powdered solid solution of a carbide or carbonitride of a combination of zirconium and niobium having a ratio of about 40 weight percent zirconium carbide and about 60 weight percent niobium carbide was added to the starting powder mixture.

Figure 2A:
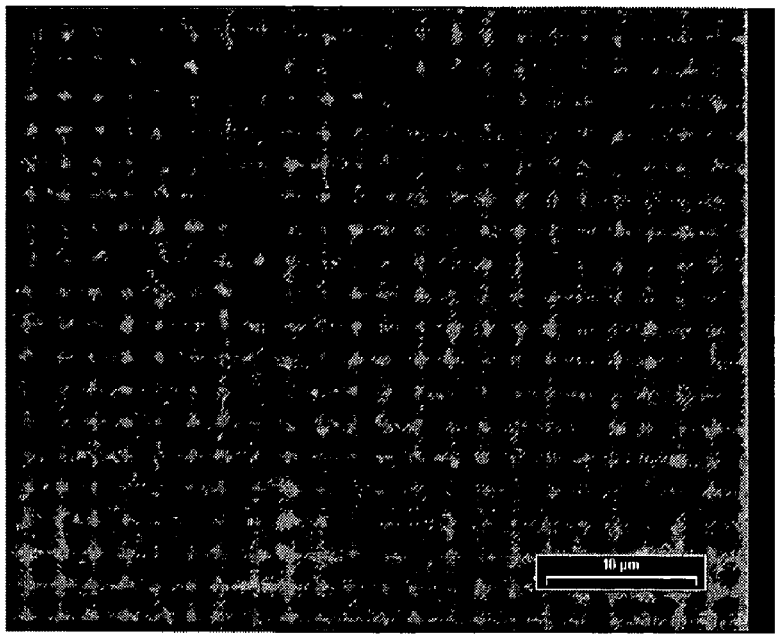
FIGS. 2A is a photomicrograph that shows the unetched microstructure of Sample (A), which is a sintered cemented carbide body, at 1,500-fold magnification (10 micrometer scale) wherein Sample (A) was produced according to the present invention as disclosed hereinafter, and Sample (A) has a porosity of <A02 as shown in FIG. 2A.
Figure 2B:
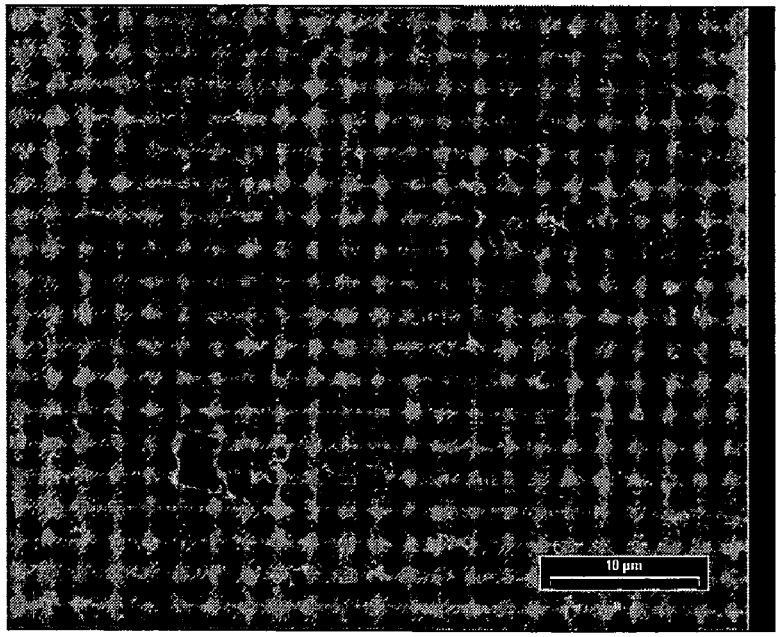
FIG. 2B is a photomicrograph that shows the unetched microstructures of Sample (B), which is a sintered cemented carbide body, at 1,500-fold magnification (10 micrometer scale) wherein Sample (B) was produced according to a conventional process as disclosed hereinafter, and Sample (B) has a residual porosity of A08 as shown in FIG. 2B.

Referring to FIG. 2A and FIG. 2B, each one of these figures is a photomicrograph at 1500×(each photomicrograph as a 10 micrometer scale) that shows the unetched microstructures of two samples; namely, Sample (A) and Sample (B), respectively. Sample (A) was produced according to the present invention using (Zr,Nb)C in the starting powder mixture and whereas Sample (B) was conventionally made by using individual carbides; namely, ZrC and NbC instead of (Zr,Nb)C in the starting powder mixture. FIG. 2A shows that Sample (A) has a porosity of less than A02 and FIG. 2B shows that Sample (B) has a porosity of A08. In addition, as can be seen in FIG. 2A, the microstructure of Sample (A) obtained by using the (Zr,Nb)C solid solution in the starting powder is much more homogeneous in terms of porosity as compared with the microstructure (see FIG. 2B) of Sample (B), which is the conventionally prepared sintered cemented carbide body using ZrC+NbC as part of the starting powder mixture.

Figure 3A:
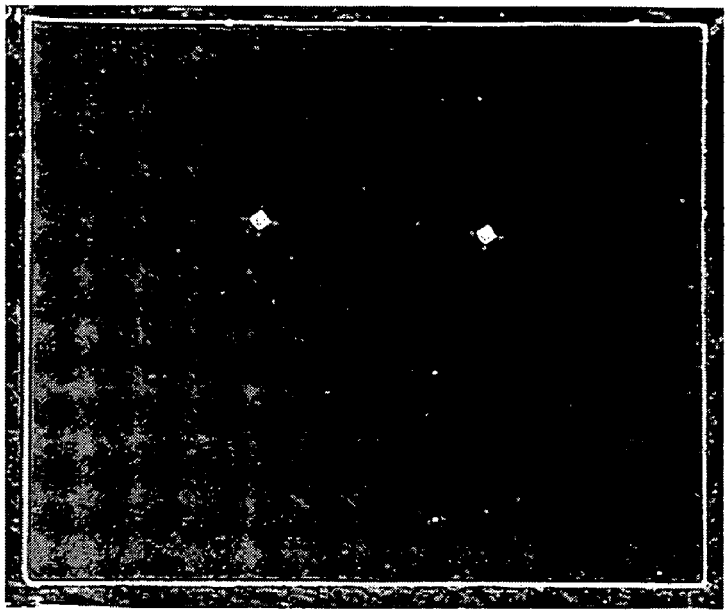
FIG. 3A is a photomicrograph of a sintered bending strength test rod, in cross section, of Sample (A) which was made according to the present invention as described hereinafter, does not show sinter distortion.
Figure 3B:
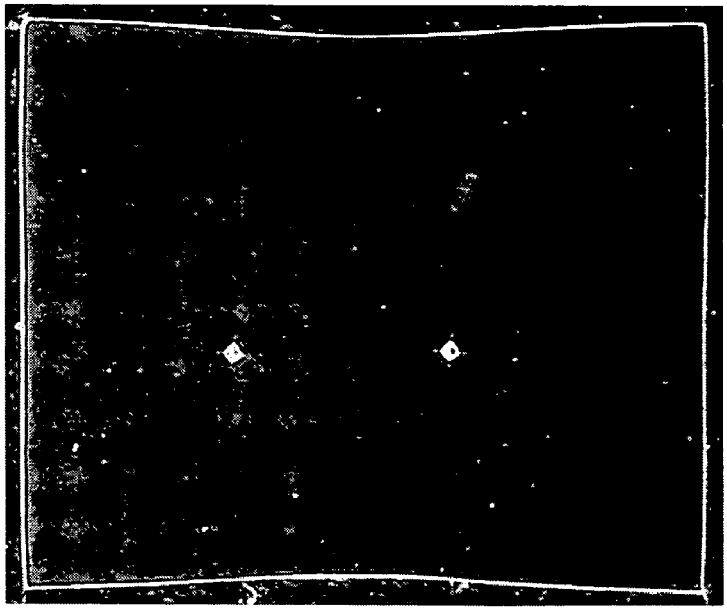
FIG. 3B is a photomicrograph of a sintered bending strength test rod, in cross section, of Sample (B) which was made in a conventional fashion as described hereinafter, very clearly shows a sinter distortion.

Referring to FIG. 3A and FIG. 3B, these figures are photomicrographs of sintered bending strength test rods wherein each is in cross section. FIG. 3B shows the microstructure of Sample (B) that is made in a conventional fashion using ZrC and NbC in the starting powder mixture wherein there is a sinter distortion that can be seen very clearly. FIG. 3A shows the microstructure of Sample (A) that was made according to the present invention using a solid solution carbide of zirconium and niobium (Zr,Nb)C wherein FIG. 3A does not show sinter distortion. This comparison shows that with respect to sinter distortion, Sample (A) is much better than the conventional Sample (B).

As indicated earlier, a further advantage of using a powdered solid solution of a carbide or carbonitride of a combination of zirconium and niobium as part of the starting powder mixture consists in the lower affinity to oxygen, as compared to conventional methods of producing sintered cemented carbide bodies, whereby it is not necessary to have a reducing sintering atmosphere. Due to the avoidance of any controlling and monitoring of the reducing quality of the sintering atmosphere, sintering becomes easier and less expensive according to the present invention as compared to the prior art.

Referring to FIG. 4, FIG. 4 is a photomicrograph of an embodiment of the sintered cemented carbide body of the present invention wherein there is shown a binder enriched surface zone free of solid solution carbide and one single homogeneous solid solution phase (MC). FIG. 4 shows that the present invention allows the production of sintered cemented carbide bodies having one single homogeneous solid solution phase as shown.

Referring to FIG. 5, FIG. 5 is a photomicrograph of an other embodiment of the sintered cemented carbide body of the present invention wherein there is shown a binder enriched surface zone free of solid solution carbide. Underneath the binder enriched surface zone free of solid solution phase there is shown a zone in which a solid solution phase MC1 exists. MC1 is light brown. Underneath the zone containing only MC1 solid solution phase, there is a zone that contains two coexisting solid solution phases. One solid solution phase is MC1 and it is light brown. The other solid solution phase is MC2 and it is dark brown. FIG. 5 shows that the present invention allows the production of sintered cemented carbide bodies having different coexisting solid solution phases (MC1; (MC1+MC2)) visible by optical microscopy located underneath an outermost binder enriched zone being free of solid solution phase.

Further details of the invention shall be described through the following examples. Table 1 sets forth the raw materials that were used in the examples that are set forth hereinafter.

TABLE 1

Raw Materials Used for the Examples

| Raw material | Manufacturer | Average particle size [μm] |
|---|---|---|
| Co | OMG | 1.3 |
| (W, Ti)C 50/50 | H.C. Starck | 1.1 |
| NbC | Kennametal | 1.5 |
| TaC | Kennametal | 1.2 |

TABLE 1-continued

Raw Materials Used for the Examples

| Raw material | Manufacturer | Average particle size [μm] |
|---|---|---|
| (Ta, Nb)C 70/30 | H.C. Starck | 2.1 |
| HfC | Cezus | 0.5 |
| ZrC | H.C. Starck | 3.0 |
| (Zr, Nb)C 40/60 | H.C. Starck | 1.7 |
| (Zr, Nb)C 50/50 | H.C. Starck | 1.1 |
| TiC/N 70/30 | H.C. Starck | 1.5 |
| TiN | H.C. Starck | 1.1 |
| WC 1 | Kennametal | 1.0 |
| WC 2 | Kennametal | 2.5 |
| WC 3 | Kennametal | 8.0 |
| WC 4 | Kennametal | 12.0 |

In regard to the processing of the examples, for each one of the examples the specified raw materials were wet milled in an attritor for 10 hours and dried. Green compacts were pressed of the resulting powder mixtures and sintered according to the sintering conditions stated in the examples. In the examples the percentages are given in weight percent unless otherwise stated.

As is well known to those skilled in the art of powder metallurgy, the element pairs tantalum and niobium as well as zirconium and hafnium in most cases of occurrence are associated with each other such that a complete separation often is difficult to obtain. This is why in commercial applications, small amounts or traces of niobium will be present in tantalum, and vice versa, and small amounts or traces of zirconium will be present in hafnium, and vice versa. This also is valid for the present disclosure, whenever these elements or compounds thereof are mentioned by their names or chemical formulae.

EXAMPLE 1

Powder mixtures A and B having the compositions (weight percent) given in Table 2 were prepared. TRS bars (ISO 3327, type B) were pressed from these powder mixtures to form green compacts. The compacts were sinter-HIPped at temperatures between 1430 and 1520 degrees Centigrade. The resulting sintered cemented carbide bodies were metallurgically tested. The results of these tests are shown in FIGS. 2A and 2B and FIGS. 3A and 3B. Sample A (according to the present invention) shows a porosity of<A02 (see FIG. 2A), whereas sample B (prior art comparative example) shows a high residual porosity (see FIG. 2B) and strong sinter distortion (see FIG. 3B).

TABLE 2

Starting Powder Mixtures for Samples (A) and (B) (weight percent)

| Sample | Co | (Zr, Nb)C 50/50 | ZrC | NbC | WC2 |
|---|---|---|---|---|---|
| (A) | 10 | 15 | | | balance |
| (B) | 10 | | 7.5 | 7.5 | balance |

The resulting sintered cemented carbide bodies of Sample (A) and Sample (B) had the following properties as reported in Table 3 below.

TABLE 3

Selected Properties for Sample (A) and Sample (B)

| | Density [g/cm$^3$] | Magnetic Saturation [0.1 μTm$^3$/kg] | Hc [Oe] | Hardness HV30 | Porosity/ Remarks |
|---|---|---|---|---|---|
| A | 12.58 | 182 | 167 | 1500 | <A02, OK (no sinter distortion) |
| B | 12.51 | 188 | 155 | 1500 | A08, sinter distortion |

In regard to the columns of Table 3, the density is reported in grams per cubic centimeter, the magnetic saturation is reported in 0.1 micro testla cubic meter per kilogram, the coercive force ($H_C$) is reported in oersteds, the hardness is reported as a Vickers Hardness Number using a 30 kilogram load, and the porosity was ascertained per a visual inspection. The test methods used to determine the properties set forth in Table 3, as well as throughout the entire patent application, are described below. The method to determine density was according to ASTM Standard B311-93(2002)e1 entitled "Test Method for Density Determination for Powder Metallurgy (P/M) Materials Containing Less Than Two Percent Porosity. The method used to determine the magnetic saturation was along the lines of ASTM Standard B886-03 entitled "Standard Test Methods for Determination of MAGNETIC Saturation (Ms) of Cemented Carbides. The method to determine coercive force was ASTM Standard B887-03 entitled "Standard Test Method for Determination of Coercivity (Hcs) for Cemented Carbides. The method to determine the Vickers hardness was along the lines of ASTM Standard E92-82(2003)e1 entitled "Standard Test Method for VICKERS Hardness of Metallic Materials". The method used to determine the porosity was along the lines of ASTM Standard B276-91(2000) entitled "Standard Test Method for Apparent Porosity in Cemented Carbides".

EXAMPLE 2

Similar to Example 1, powder mixtures C through G were prepared, as given in Table 4 below.

TABLE 4

Starting Powder Mixtures for Samples C through G

| | Co | (Zr, Nb)C 50/50 | TiC† | TaC | HfC | WC3 |
|---|---|---|---|---|---|---|
| C | 6.0 | 7.5 | | | | balance |
| D | 6.0 | 5.0 | 2.5 | | | balance |
| E | 6.0 | 3.25 | 2.5 | 1.75 | | balance |
| F | 6.0 | 3.0 | 2.5 | 1.0 | 1.0 | balance |
| G | 6.0 | | 2.5 | 5.0* | | balance |

*as (Ta, Nb)C 70/30
†as (W, Ti)C 50/50

Cutting inserts were pressed from powder mixtures C to G in geometry CNMG120412-UN, then sintered (sinter-HIP 1505° C./85 min) and CVD coated to form a standard multilayer coating comprised of titanium carbonitride and alumina layers. All samples were coated equally. The resulting sintered bodies had the following properties as set forth in Table 5 below.

TABLE 5

Selected Properties for Samples C through G

| | Density [g/cm$^3$] | Magnetic Saturation [0.1 μTm$^3$/kg] | Hc [Oe] | Hardness HV30 |
|---|---|---|---|---|
| C | 13.95 | 91 | 199 | 1560 |
| D | 13.56 | 106 | 216 | 1560 |
| E | 13.72 | 106 | 189 | 1540 |
| F | 13.66 | 108 | 185 | 1500 |
| G | 13.88 | 111 | 165 | 1500 |

These cutting inserts were subjected to deformation resistance turning tests under the following conditions:

Workpiece material: 42 CrMo4 (1.7225)—alloy steel

Cutting speed: 500, 550 m/min, from 550 m/min in stages of 25 m/min increasing up to failure of the insert due to plastic deformation because of thermal overloading.

Cutting time: 15 sec. for each cutting speed

Feed rate: 0.4 mm/rev.

Cutting depth: 2.5 mm

Coolant: none

The results of these tests are set forth in Table 6 below.

TABLE 6

Test Results for Examples C through G

| Cutting speed m/min | Cutting time per cutting speed [seconds] G Prior art | C | D | E | F |
|---|---|---|---|---|---|
| 500 | 15 | 15 | 15 | 15 | 15 |
| 550 | 15 | 15 | 15 | 15 | 15 |
| 575 | not reached | 15 | 15 | 15 | 15 |
| 600 | not reached | 15 | 15 | 15 | 15 |
| 625 | not reached | 4 | 15 | 8 | 13 |
| 650 | not reached | not reached | 2 | not reached | not reached |
| Σ cutting time | 30 | 64 | 77 | 68 | 73 |

Further, CVD coated (same coatings as in Example 2) cutting inserts from powder mixtures C to G were subjected to a wear turning test under the following parameters:

Workpiece material: 42 CrMo4 (1.7225)-alloy steel

Cutting speed: 320 and 340 m/min

Cutting time: 2 min for each cutting speed

Feed rate: 0.3 mm/rev.

Cutting depth: 2.5 mm

Coolant: none

The results are set forth in Table 7 below that report the amount of flank wear in millimeters.

TABLE 7

Results of Testing of Samples C through G

| Cutting speed m/min | Flank wear [mm] G Prior art | C | D | E | F |
|---|---|---|---|---|---|
| 320 | 0.19 | 0.17 | 0.15 | 0.19 | 0.17 |
| 340 | 0.70 | 0.30 | 0.19 | 0.33 | 0.24 |

Test pieces were pressed and sintered with powder mixtures D, C, F and G. These test pieces were subjected to a hot hardness test (Vickers hardness) under the following conditions:

Test weight: 1000 grams

Test temperatures: room temperature RT, 400, 600, 800 and 900° C.

The results of the hardness testing are set forth in Table 8 below.

TABLE 8

Results of Vickers Hardness Testing for Samples D, C, F and G

| Sample | RT | 400° C. | 600° C. | 800° C. | 900° C. |
|---|---|---|---|---|---|
| D | 1685 | 1460 | 1180 | 789 | 599 |
| C | 1686 | 1372 | 1062 | 718 | 536 |
| F | 1710 | 1375 | 1116 | 730 | 553 |
| G prior art | 1636 | 1174 | 969 | 645 | 498 |

Just as with the hot hardness turning tests, the Vickers hardness (hot hardness) test shows for the sintered bodies according to the present invention a clearly increased resistance against plastic deformation at higher temperatures as compared to the prior art.

The compositions of the solid solution carbide (SSC) phase of samples C, D, E and F were analyzed by scanning electron microscopy (SEM) with the assistance of EDAX. In samples D, E and F two different SSC-phases could be identified by optical microscopy, whereas sample C showed one single SSC-phase, only. Where two different SSC-phases were present, the darker one was richer in tungsten and lower in zirconium, as compared with the lighter one. The results of the above determination are reported in Table 9 below that presents the composition of the solid solution carbides (as sintered) in weight percent.

TABLE 9

Compositions of Solid Solution Phases for Samples C, D, E and F

| | | Zr | Nb | Ti | W | Ta | Hf | SSC-phases found by optical microscopy |
|---|---|---|---|---|---|---|---|---|
| C | | 25–40 | 40–75 | | 1–25 | | | 1 |
| D | SSC 1 | 12–15 | 18–28 | 9–15 | 45–65 | | | 2 |
| | SSC 2 | 40–52 | 23–45 | 1–6 | 4–27 | | | |
| E | SSC 1 | 7–10 | 10–17 | 12–17 | 48–62 | 5–13 | | 2 |
| | SSC 2 | 43–58 | 15–25 | 3–6 | 12–32 | 5–10 | | |
| F | SSC 1 | 5–9 | 10–16 | 13–20 | 48–56 | 8–13 | 1–6 | 2 |
| | SSC 2 | 15–43 | 7–19 | 4–11 | 15–43 | 1–10 | 10–19 | |

EXAMPLE 3

Similar to Example 1, powder mixtures H through K as given in Table 10 were prepared:

TABLE 10

Starting Powder Mixtures for Samples H through K

| | Co | (Zr, Nb)C 50/50 | TiC† | TaC | WC* |
|---|---|---|---|---|---|
| H | 6.0 | 2.0 | | | balance |
| I | 6.0 | 2.0 | 0.5 | | balance |
| J | 6.0 | 2.0 | 1.0 | | balance |
| K | 6.0 | | | 3.5 | balance |

*Mixture of WC1 and WC2: 75% WC1, 25% WC2

†as (W, Ti)C 50/50

From powder mixtures H, I, J and K (prior art), cutting inserts having the geometry CNMG120412-UN were manufactured, pressed, sintered/sinter-HIP (1505° C./85 min) and CVD coated. The resulting sintered bodies had the following properties as reported in Table 11.

TABLE 11

Selected properties of Samples H through K

| | Density [g/cm$^3$] | Magnetic Saturation [0.1 μTm$^3$/kg] | Hc [Oe] | Hardness HV30 |
|---|---|---|---|---|
| H | 14.71 | 95 | 253 | 1660 |
| I | 14.57 | 96 | 300 | 1700 |
| J | 14.42 | 100 | 289 | 1680 |
| K | 14.89 | 96 | 245 | 1640 |

These cutting inserts were subjected to hot hardness tests under the following conditions:

Workpiece material: 42 CrMo4 (1.7225)—alloy steel

Cutting speed: increasing from 450 m/min in stages of 25 m/min until failure of the inserts due to plastic deformation because of thermal overloading.

Cutting time: 15 sec. for each cutting speed

Feed rate: 0.4 mm/rev.

Cutting depth: 2.5 μm

Coolant: none

The results of these cutting tests are set forth in Table 12 below.

TABLE 12

Results of Cutting Tests for Samples K through J

| Cutting speed m/min | Cutting time per cutting speed [seconds] K Prior art | H | I | J |
|---|---|---|---|---|
| 450 | 15 | 15 | 15 | 15 |
| 475 | 15 | 15 | 15 | 15 |
| 500 | 9 | 15 | 15 | 15 |
| 525 | not reached | 2 | 13 | 15 |
| 550 | not reached | not reached | not reached | 5 |
| 575 | not reached | not reached | not reached | not reached |
| Σ time | 39 | 47 | 58 | 65 |

A review of these test results show a tool life improvement between about 20 percent and about 67 percent.

Further inserts made from mixtures H to K and CVD coated. These coated inserts were subjected to a wear turning test with increasing cutting speeds under the following parameters:

Workpiece material: 42 CrMo4 (1.7225)—alloy steel
Cutting speed: 260, 300, 320 and 340 m/min
Cutting time: 2 min each cutting speed
Feed rate: 0.5 mm/rev.
Cutting depth: 1.5 mm
Coolant: none The results are set forth in Table 13.

TABLE 13

Results of Cutting Tests for Coated Samples K through J

| Cutting speed m/min | Flank wear [mm] K Prior art | H | I | J |
|---|---|---|---|---|
| 260 | 0.14 | 0.14 | 0.13 | 0.13 |
| 300 | 0.20 | 0.20 | 0.17 | 0.17 |
| 320 | 0.31 | 0.25 | 0.21 | 0.21 |
| 340 | not reached | 0.39 | 0.29 | 0.29 |

EXAMPLE 4

Powder mixtures L and M (prior art) were prepared according to the compositions given in Table 14 (the compositions are set forth in weight percent below:

TABLE 14

Starting Powder Mixtures for Samples L and M

| | Co | (Zr, Nb)C 50/50 | TiC† | TiN | TiCN 70/30 | TaC | NbC | WC4 |
|---|---|---|---|---|---|---|---|---|
| L | 6.3 | 4.0 | 0.8 | | 1.2 | 1.0 | 0.3 | balance |
| M | 6.3 | | 1.7 | 0.8 | | 5.4* | | balance |

*as (Ta, Nb)C 70/30
†as (W, Ti)C 50/50

Cutting inserts were pressed from powder mixtures L and M in geometry CNMG120412-UN, then sintered (sinter-HIP 1505° C./85 min) and CVD coated. The resulting sintered bodies had the following properties as reported in Table 15. In addition to the properties reported for the above examples, Table 15 also reports the depth of the cobalt-enriched SSC-free zone in micrometers and the volume percent of cubic carbides present except for tungsten carbide.

TABLE 15

Selected Properties of Cutting Inserts of Samples L and M

| | Density [g/cm$^3$] | Magnetic Saturation [0.1 μTm$^3$/kg] | Hc [Oe] | Hardness HV30 | Co enriched SSC free zone [μm] | Cubic Carbides Vol.- % |
|---|---|---|---|---|---|---|
| L | 13.57 | 114 | 166 | 1460 | 25 | 14.8 |
| M | 13.92 | 113 | 149 | 1460 | 25 | 13.7 |

These cutting inserts were subjected to a toughness test (interrupted cutting test) with the following conditions:

Workpiece material: Ck60 (1.1221)—carbon steel
Cutting speed: 200 m/min
Cutting depth: 2.5 mm
Feed rate: 0.3, 0.4, 0.5 mm/rev., 100 impacts per feed rate.
Coolant: none The feed was increased according to the mentioned increments until breakage occurred. Table 16 below sets forth the results of the toughness test.

TABLE 16

Results of Toughness Test (Interrupted Cutting) for Samples L and M

| | No. of impacts until breakage Insert 1 | Insert 2 | Insert 3 | Average |
|---|---|---|---|---|
| L | 950 | 875 | 950 | 925 |
| M prior art | 875 | 692 | 820 | 796 |

Additional cutting inserts were subjected to a deformation resistance turning test under following conditions:

Workpiece material: 42 CrMo4 (1.7225)—alloy steel
Cutting speed: 400, 430, 460 m/min in stages of 30 m/min increasing up to failure of the insert due to plastic deformation because of thermal overloading
Cutting time: 5 sec. for each cutting speed
Cutting depth: 2.5 mm
Feed rate: 0.3 mm/rev.
Coolant: none Table 17 sets for the results of these deformation resistance turning tests.

TABLE 17

Results of Deformation Resistance Turning Tests for Samples L and M

| Cutting speed m/min | M Prior Art | L |
|---|---|---|
| 400 | 5 | 5 |
| 430 | 5 | 5 |
| 460 | not reached | 5 |
| 490 | not reached | 5 |
| Total Cutting Time | 10 sec. | 20 sec. |

Further cutting inserts were subjected to a wear turning test under the following conditions:

Workpiece material: 42 CrMo4 (1.7225)—alloy steel

Cutting speed: 208 m/min

Cutting depth: 2.5 mm

Feed rate: 0.4 mm/rev.

Coolant: none

The results of the wear turning test are reported in Table 18 below.

TABLE 18

Results of Wear Turning Tests for Samples L and M

| | Flank wear [mm] | |
|---|---|---|
| Cutting time | M prior Art | L |
| 2 min | 0.191 | 0.153 |
| 4 min | 0.352 (End of Life) | 0.250 |

EXAMPLE 5

Powder mixtures N and O were prepared having the compositions (in weight percent) given in Table 19.

TABLE 19

Starting Powder Compositions for Samples N and O

| | Co | (Zr, Nb)C 50/50 | (Zr, Nb)C 40/60 | TiC† | TiCN 70/30 | TaC | NbC | WC3 |
|---|---|---|---|---|---|---|---|---|
| N | 6.0 | 8.0 | | 1.0 | 1.5 | 1.0 | 0.4 | balance |
| O | 6.0 | | 10.0 | 1.0 | 1.5 | 1.0 | 0.4 | balance |

†as (W, Ti)C 50/50

From starting powder mixtures N and O, green compacts were pressed (TRS bars, ISO 3327, type B) and vacuum sintered at 1530° C./60 min. The as sintered properties of Samples N and O are set forth in Table 20 below:

TABLE 20

Selected Properties of Samples N and O

| | Density [g/cm$^3$] | Magnetic Saturation [0.1 μTm$^3$/kg] | Hc [Oe] | Hardness HV30 | Co enriched SSC free zone [μm] |
|---|---|---|---|---|---|
| N | 13.10 | 108 | 221 | 1610 | 20 |
| O | 12.89 | 103 | 206 | 1660 | 15 |

An analysis of the sintered bodies revealed that Sample N shows two different coexisting solid solution phases that were identified by optical microscopy. By optical microscopy Sample O showed one single homogeneous solid solution phase. The compositional results of the analysis of Samples N and O are set forth in Table 21 below.

TABLE 21

Composition of solid solution carbides (as sintered) in Samples N and O (components are set forth in weight percent)

| | | Zr | Nb | Ti | W | Ta | SSC-phases found by optical microscopy |
|---|---|---|---|---|---|---|---|
| N | SSC1* | 12–17 | 19–22 | 8–13 | 44–48 | 8–11 | 2 |
| | SSC2 | 33–38 | 49–57 | 1–4 | 2–10 | 2–7 | |
| O | | 13–16 | 24–28 | 8–10 | 39–45 | 7–10 | 1 |

*Thickness of SSC1-zone: about 80 to 120 μm

The problems of the prior art mentioned above are overcome by the present invention which provides a sintered cemented carbide body having increased resistance to plastic deformation, comprising tungsten carbide, a binder phase comprising at least one metal of the iron group or an alloy thereof, and one or more solid solution phases each one of which comprising at least one of the carbides and carbonitrides of a combination of zirconium, niobium, and tungsten. Further, the problems of the prior art are overcome by the method of the present invention wherein this method is a method of producing said sintered cemented carbide body, according to the present invention, comprises the steps of:

(a) providing a powder mixture comprising tungsten carbide, a binder metal powder comprising at least one metal of the iron group or an alloy thereof, and at least one of the carbides and carbonitrides of both, zirconium and niobium;

(b) forming a green compact of said powder mixture;

(c) vacuum sintering or sinter-HIP said green compact at a temperature of from 1400 to 1560° C.;

wherein in step (a) a powdered solid solution of the carbides or carbonitrides of zirconium and niobium is used to form said powder mixture. The sintered cemented carbide bodies of the present invention have increased resistance to plastic deformation, resulting in improved wear resistance and extended life time of cutting tools produced from said sintered cemented carbide bodies. Besides, a considerable minimization of porosity and sinter distortion as compared to prior art sintered cemented carbide bodies, is obtained by the present invention.

There is also a considerable advantage of the method of the present invention which, according to a preferred embodiment thereof, uses a powdered solid solution of (Zr,Nb)C instead of the conventionally used single carbides ZrC and NbC. This advantage is due to the lower affinity of the solid solution of (Zr,Nb)C to oxygen that results in that neither a reducing sintering atmosphere is necessary nor a continuous control of the reducing force of the sinter atmosphere is necessary.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A method of producing a sintered cemented carbide body comprising the steps of providing a powder mixture comprising tungsten carbide powder, a binder metal powder comprising at least one metal of the iron group or an alloy thereof, and at least one or both of a solid solution carbide powder of a combination of zirconium and niobium and a solid solution carbonitride powder of a combination of zirconium and niobium;

forming a green compact of said powder mixture; and vacuum sintering or sinter-HIP said green compact at a temperature of from 1400 to 1560° C. wherein the solid solution carbide powder of zirconium and niobium or the solid solution carbonitride powder of zirconium and niobium having a mass ratio Nb/(Zr+Nb) equal to greater than about 0.5.

2. The method of claim 1 wherein the solid solution carbide powder of zirconium and niobium or the solid solution carbonitride powder of zirconium and niobium having a mass ratio Nb/(Zr+Nb) greater than or equal to about 0.6.

3. The method of claim 1 wherein the binder metal powder comprises one or more of cobalt powder, nickel powder and iron powder.

4. The method of claim 3 wherein said binder metal powder additionally comprises at least one of chromium and tungsten.

5. The method of claim 1 wherein said binder metal powder comprises between about 3 weight percent and about 15 weight percent of the total mass of said powder mixture.

6. The method of claim 1 wherein said powder mixture additionally comprises at least one carbide, nitride or carbonitride of one or more of titanium, hafnium, vanadium, tantalum, chromium, and molybdenum.

7. The method of claim 1 wherein the total of the solid solution carbide powder of zirconium and niobium and the solid solution carbonitride powder of zirconium and niobium comprises between about 1 weight percent and about 15 weight percent of the total mass of said powder mixture.

8. The method of claim 1 wherein said powder mixture comprises at least one of the elements titanium, hafnium, vanadium, tantalum, chromium and molybdenum in an amount between about 1 weight percent and about 8 weight percent of the total mass of said powder mixture.

9. A method of producing a sintered cemented carbide body comprising the steps of providing a powder mixture comprising tungsten carbide powder, a binder metal powder comprising at least one metal of the iron group or an alloy thereof, and at least one or both of a solid solution carbide powder of a combination of zirconium and niobium and a solid solution carbonitride powder of a combination of zirconium and niobium; forming a green compact of said powder mixture; and vacuum sintering or sinter-HIP said green compact at a temperature of from 1400 to 1560° C. wherein the total of the solid solution carbide powder of zirconium and niobium and the solid solution carbonitride powder of zirconium and niobium comprises between greater than 10 weight percent and about 15 weight percent of the total mass of said powder mixture.

10. A method of producing a sintered cemented carbide body comprising the steps of providing a powder mixture comprising tungsten carbide powder, a binder metal powder comprising at least one metal of the iron group or an alloy thereof, and at least one or both of one or both of a solid solution carbide powder consisting essentially of zirconium and niobium or a solid solution carbonitride powder consisting essentially of zirconium and niobium; forming a green compact of said powder mixture; and vacuum sintering or sinter-HIP said green compact at a temperature of from 1400 to 1560° C. wherein the solid solution carbide powder of zirconium and niobium or the solid solution carbonitride powder of zirconium and niobium having a mass ratio Nb/(Zr+Nb) equal to greater than about 0.5.

11. A method of producing a sintered cemented carbide body comprising the steps of providing a powder mixture comprising tungsten carbide powder, a binder metal powder comprising at least one metal of the iron group or an alloy thereof, and at least one or both of one or both of a solid solution carbide powder consisting essentially of zirconium and niobium or a solid solution carbonitride powder consisting essentially of zirconium and niobium;

forming a green compact of said powder mixture; and vacuum sintering or sinter-HIP said green compact at a temperature of from 1400 to 1560° C. wherein the solid solution carbide powder of zirconium and niobium or the solid solution carbonitride powder of zirconium and niobium having a mass ratio Nb/(Zr+Nb) greater tan or equal to about 0.6.

12. A method of producing a sintered cemented carbide body comprising the steps of providing a powder mixture comprising tungsten carbide powder, a binder metal powder comprising at least one metal of the iron group or an alloy thereof, and at least one or both of one or both of a solid solution carbide powder consisting essentially of zirconium and niobium or a solid solution carbonitride powder consisting essentially of zirconium and niobium; forming a green compact of said powder mixture; and vacuum sintering or sinter-HIP said green compact at a temperature of from 1400 to 1560° C. wherein the total of the solid solution carbide powder of zirconium and niobium and the solid solution carbonitride powder of zirconium and niobium comprises between greater than 10 weight percent and about 15 weight percent of the total mass of said powder mixture.

* * * * *